United States Patent [19]

Wright

[11] 4,071,138

[45] Jan. 31, 1978

[54] COTTON BALE COVER

[76] Inventor: Herbert J. Wright, Rte. 4, Box 233, Piedmont, S.C. 29673

[21] Appl. No.: 581,726

[22] Filed: May 29, 1975

[51] Int. Cl.[2] ..... B65D 71/00

[52] U.S. Cl. ..... 206/83.5

[58] Field of Search ..... 66/190, 192, 193, 195, 66/125 R, 202, 68 R; 206/83.5

[56] References Cited

U.S. PATENT DOCUMENTS

| | | | |
|---|---|---|---|
| 2,140,696 | 12/1938 | Ferrari | 66/195 |
| 3,331,222 | 7/1967 | Marks | 66/125 R |
| 3,787,272 | 1/1974 | Nisbet et al. | 66/195 |

OTHER PUBLICATIONS

Paling, D. F., *Warp Knitting Technology,* CH.9, p. 173, Columbine Press, Manchester and London, 11-2-1965.

Reisfeld, A., *Warp Knitting Engineering,* N.Y. Nat. Knitted Outerwear, Ass. 1966, Chapter 3, pp. 29-30.

*Primary Examiner*—William T. Dixson, Jr.

*Attorney, Agent, or Firm*—Bailey, Dority & Flint

[57] ABSTRACT

A cover is illustrated for use in a cotton bale for transporting fibers to a textile mill wherein the fibers are confined in compression by the cover and by strapping passed thereabout. The cover is knitted from yarn, consisting essentially of cotton yarn and spun on an open end spinning apparatus, possessing a yarn count of from about 3 to about 10, said fibers being warp knit and having a construction including chain stitches and cross lapping yarn.

7 Claims, 6 Drawing Figures

COTTON BALE COVER

BACKGROUND OF THE INVENTION

Covers for cotton bales have heretofore been constructed utilizing a woven jute construction. Such covers possess disadvantages in that they are relatively expensive and tend to contaminate the cotton with the jute fibers. Efforts to supply cotton bale covers having improved characteristics are illustrated in U.S. Letters Pat. Nos. 3,647,061 and 3,674,139. Such covers are of laminated construction however, and tend to be expensive, presenting further problems in that they are not sufficiently air permeable when the cotton is compressed for baling and tend to cause mildew. Ring spun yarn is impractical for use in the present application because of the high level of defects in the yarn making warp knitting impractical. By the use of open end spinning, it is possible to use a lower grade of cotton for the courser yarn counts and yet produce yarn of acceptable quality for warp knitting. Such fabrics may be made to any desired width and possess a true selvage. It is thus possible to produce a yarn consisting essentially of cotton and suitable to be used on warp knitting equipment for constructing a bale cover.

Normally, course yarn counts are not run on warp knitting machines especially when such yarns are constructed of lower quality fiber. Having determined that it is possible to run such yarn on warp knitting machines, it is necessary to find a stitch construction to meet the requirements of a bale cover. A construction similar to a construction normally utilized in trico shirting has been found to produce a satisfactory cover. Cotton bale covers must maintain their shape and be substantially ravel proof so that the compressed bale will not deteriorate excessively, or the fiber of the bale contaminated, when the cover is cut for cotton sampling. In this connection in most warp knit fabrics, all ends are form connected whereas in woven fabrics, the ends are friction connection. Such constructions utilizing course yarn counts provide suitable cover or opacity to protect and retain the fiber mass of the bale in compression. The yarns tend to keep separated maintaining spacing with less tendency for the yarns to bunch together. Moreover, such construction permits a design for balanced tear and tensile strength in both directions without overuse of one to achieve the other.

Accordingly, it is an important object of this invention to produce a cover of light weight material which is warp knit so as to possess stretchability, making for a neater bale and possessing suitable absorption properties to avoid mildew.

Another important object of the invention is to produce a bale cover which is substantially ravel proof and possesses a balance of stretch characteristics in both directions.

Another object of this invention is to provide a bale cover which produces when processed as waste a fiber compatible for use in a variety of applications.

BRIEF DESCRIPTION OF THE INVENTION

It has been found that a suitable fabric may be constructed for practical use as a cover for a cotton bale employing a course yarn consisting substantially of cotton by spinning the yarn on open end spinning equipment and then fabricating same on a warp knit machine. It has been found that a suitable construction possessing stability in both directions may be had utilizing a chain stitch in the length direction and cross lapping yarn, preferably including a cross lapping stitch.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
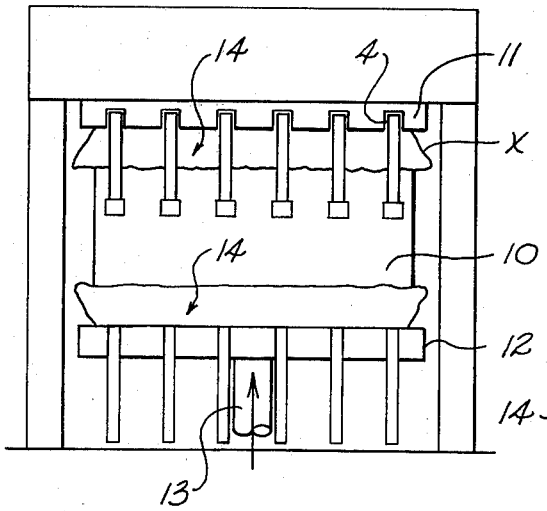
FIG. 1 is a side elevation illustrating a cover constructed in accordance with the present invention being applied to form a bale, preparatory to compression.
Figure 2:
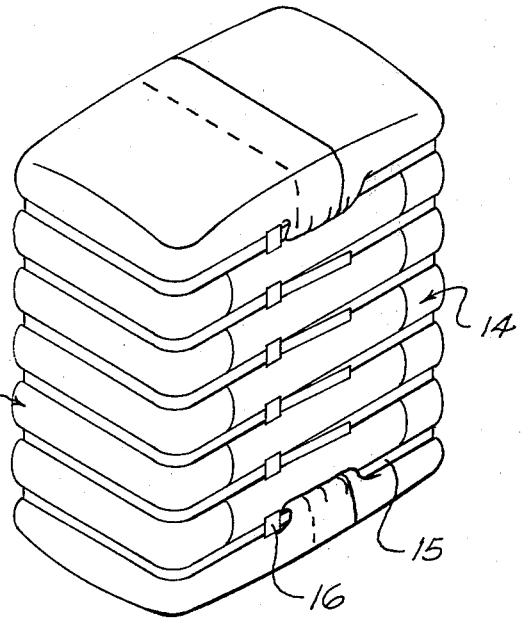
FIG. 2 is a perspective view illustrating a cotton bale utilizing a cover constructed in accordance with the present invention.

The drawing illustrates a cover for use in a cotton bale containing ginned cotton fibers for transport to a textile mill wherein a predetermined mass of such cotton fibers is contained and confined in compression by the cover enshrouding the mass and by spaced tensioned strapping passed about the cover. A fabric is knitted from yarn consisting essentially of cotton fibers. The yarn is spun on an open end spinning apparatus as to possess a yarn count of from 3 to 10 and preferably from about 4 to about 6. The extremes are limited simply by a yarn course enough to provide sufficient strength yet providing the necessary cover. The fabric is warp knit from the yarn in a stitch construction, including chain stitches and cross lapping yarn tying the chain stitches together in a direction transverse to the chain stitches. Thus, the cotton fibers of the cover engage the mass of cotton fibers in suitable compression avoiding contamination thereof.

FIG. 1 illustrates a cotton mass 10 contained between platens 11 and 12 of a press. The ram 13 compresses the fibers 10 between covers, each of which is broadly designated at 14. Suitable strapping is illustrated at 15 and spaced bands of strapping are utilized provided with suitable fastening means such as the buckles 16.

Figure 3:
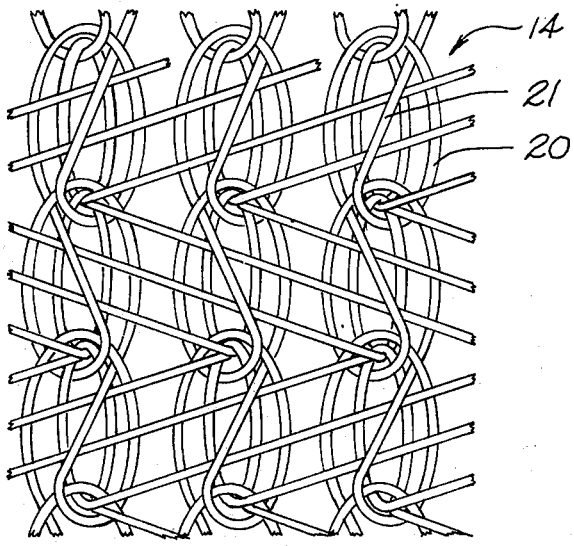
FIG. 3 illustrates the stitch construction of the fabric of the invention.

Although it is desirable to have a degree of stretch in bale wrapping fabric, such should possess a substantially parabolic stress-strain characteristic, with a maximum break elongation of approximately 50%. Also, any stress in one axis, should not result in excessive contraction perpendicular to the stress direction. To fulfill this requirement a construction consisting of a cross lapping yarn in the ground bar and a chain stitch on the top bar would provide the optimum utilization of yarns. This construction permits the balancing, i.e., approximately equal tensile strength in width and length directions for any given yarn size. FIG. 3 illustrates a suitable construction wherein the chain stitch is designated at 20 and a cross lapping stitch is designated at 21.

Figure 4:
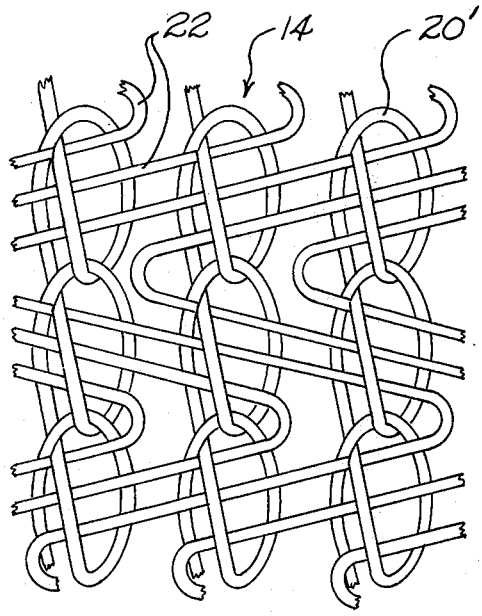
FIG. 4 illustrates a modified stitch construction in accordance with the present invention.
Figure 5:
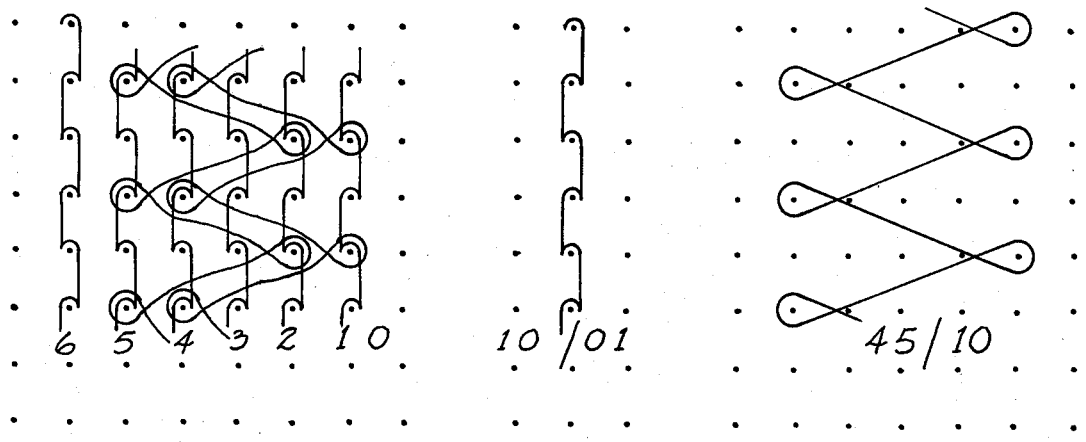
FIG. 5 is a point diagram and formula for the fabric construction illustrated in FIG. 3.
Figure 6:
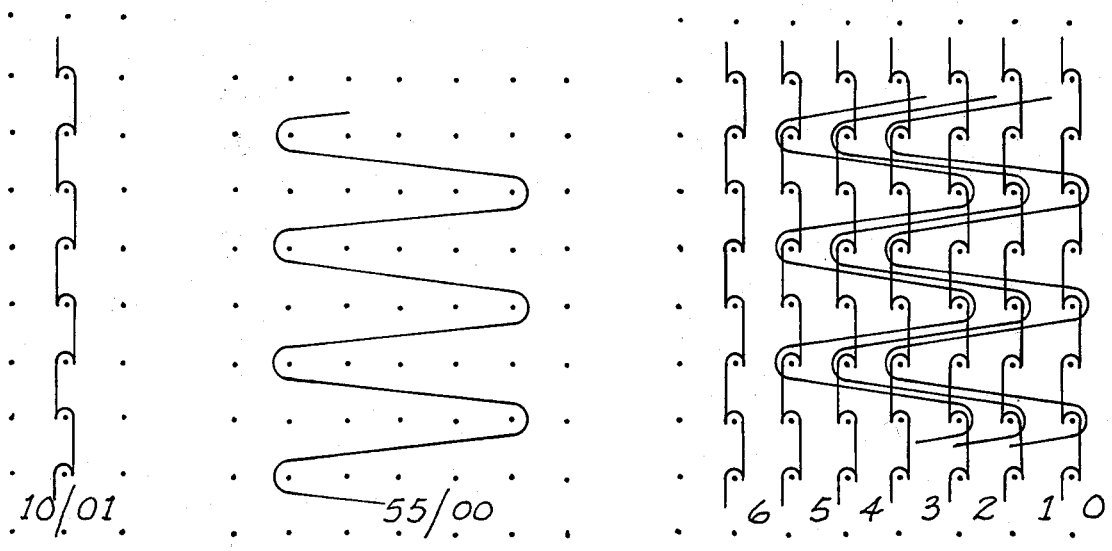
FIG. 6 is a point diagram and formula for the fabric construction illustrated in FIG. 4.

An alternate construction consisting of a cross lapping inlay 22 in the ground and a chain stitch 20' on the top bar would permit equal stability, but would normally require a heavier top bar yarn in order to balance width and lengthwise tensile strength (FIG. 4). A disadvantage of this construction lies in the fact that such configurations are prone to ravel whenever an individual end of the chain stitch is exposed to a pulling force. Although the combination of cross lapping inlay and chain stitch provides the best cover for the least amount of yarn, this fabric construction would not alone provide for the most desirable requirements of a bale wrapping fabric, but would suffice for most uses of a bale cover.

Using alternate sections of fabric having an inlay with sections of fabric having cross lapping stitches, with a chain stitch on the top bar, in repeated intervals of one to four inches, a more desirable fabric would be provided, since any ravelling which could occur in the portion where a cross lapping inlay is used, would not go beyond the portion with the cross lapping stitches. Cross lapping stitches and cross lapping inlay can be designed to lap over one to three or more needles for each course. To obtain stability and balance it was found desirable to make cross lapping motions over four needles. Thus, another alternate construction (not shown) is possible, together with other possible constructions utilizing chain stitches and cross lapping yarn tying said chain stitches together in a direction transverse to the chain stitches.

To achieve reasonable fabric stability, since no wet or other finishing application is required, the number of courses per inch of fabric length, is to be selected to obtain a tight loop. This will depend on the yarn size utilized. This is to end, depending upon the stiffness of the yarn forming the loops, sufficient friction is created for holding the adjacent loops to prevent the loops from deforming under normal handling.

While a preferred embodiment of the invention has been described using specific terms, such description is for illustrative purposes only, and it is to be understood that changes and variations may be made without departing from the spirit or scope of the following claims.

What is claimed is:

1. A covered bale comprising:

a predetermined mass of cotton fibers contained and confined in compression in the form of a bale for transport to a textile mill, a cover enshrouding the mass of fibers, spaced tensioned strapping passing about said cover, said cover formed from a fabric knitted from yarn consisting essentially of cotton fibers, said yarn forming said knitted fabric being spun on open end spinning apparatus and possessing a coarse yarn count of from about 3 to 10 providing air permeability for aiding in avoiding mildew of said cotton fibers within said bale, said fabric being warp knit from said yarn in a fabric construction including chain stitches in the length direction and cross lapping yarn tying said chain stitches together in a direction transverse to the chain stitches; and said fabric construction of course cotton yarn being porous and air permeable to avoid mildew of said mass of cotton fibers within said bale, said fabric being stretchable and stable in the direction of the chain stitch and in the direction of the cross lapping yarn to aid in maintaining compression of said bale, and said cotton fibers of the cover engaging the mass of cotton fibers being compatible therewith avoiding contamination thereof.

2. The structure set forth in claim 1 wherein said yarn count is from about 4 to about 6.

3. The structure set forth in claim 1 wherein said cross lapping yarn is a cross lapping stitch.

4. The structure set forth in claim 1 wherein said cross lapping yarn is a cross lapping inlay.

5. The structure set forth in claim 1 wherein said cross lapping yarn includes a cross lapping stitch.

6. The structure set forth in claim 1 wherein said fabric includes chain stitches with sections having cross lapping stitches alternating with sections having cross lapping inlay.

7. The structure set forth in claim 2 wherein said cross lapping yarn includes a cross lapping stitch.

* * * * *